US006438805B1

(12) United States Patent
Goss et al.

(10) Patent No.: US 6,438,805 B1
(45) Date of Patent: Aug. 27, 2002

(54) PILLOW SECURING DEVICE

(76) Inventors: Carrol Goss, P.O. Box 1077, Burkesville, KY (US) 42717; Karla White, 71 Reno Rd., Cadiz, KY (US) 42211

( * ) Notice: Subject to any disclaimer, the term of this patent is extended or adjusted under 35 U.S.C. 154(b) by 0 days.

(21) Appl. No.: 09/460,792

(22) Filed: Dec. 14, 1999

(51) Int. Cl.[7] ..... A44B 21/00; A47C 21/00; A47G 9/00

(52) U.S. Cl. ..... 24/302; 24/171; 24/300; 24/301; 5/460

(58) Field of Search ..... 24/302, 301, 300, 24/171; 5/460

(56) References Cited

U.S. PATENT DOCUMENTS

| | | | | | |
|---|---|---|---|---|---|
| 327,622 | A | * | 10/1885 | Tourgee et al. | 24/171 |
| 694,070 | A | | 2/1902 | Palmer | |
| 1,239,030 | A | * | 9/1917 | Munn | 24/301 |
| 1,365,169 | A | * | 1/1921 | Goldberg | 24/302 |
| 1,458,353 | A | * | 6/1923 | Morse | 24/301 |
| 1,782,057 | A | * | 11/1930 | Bollinger | 24/301 |
| 2,328,474 | A | * | 8/1943 | Lewis | 24/300 |
| 2,986,202 | A | | 5/1961 | Yates | |
| 3,346,892 | A | | 10/1967 | Du Priest | |
| 3,506,988 | A | | 4/1970 | Saddoris | |
| 4,345,346 | A | * | 8/1982 | Holtz | 5/437 |
| 4,574,412 | A | | 3/1986 | Smith | |
| 4,815,154 | A | | 3/1989 | Grimes | |
| 5,070,558 | A | | 12/1991 | Fenley | |
| 5,230,451 | A | * | 7/1993 | Onozawa | 24/302 |
| 5,237,713 | A | | 8/1993 | Prager | |
| 5,279,310 | A | | 1/1994 | Hsien | |
| 5,437,401 | A | * | 8/1995 | Seltzer | 224/151 |
| 5,475,886 | A | | 12/1995 | Mintz | |
| 5,557,815 | A | | 9/1996 | Mintz et al. | |
| 5,608,951 | A | * | 3/1997 | Chou | 24/302 |
| 5,675,841 | A | * | 10/1997 | Jackson | 24/302 |
| 5,718,010 | A | | 2/1998 | Beier | |
| 5,809,620 | A | * | 9/1998 | Crowley et al. | 24/302 |
| 5,904,406 | A | | 5/1999 | Stewart | |

* cited by examiner

*Primary Examiner*—Victor Sakran
(74) *Attorney, Agent, or Firm*—Karen Lee Orzechowski; Liniak, Berenato, Longacre & White LLC

(57) ABSTRACT

A pillow securing device for releasably holding a pillow in position on an elevated surface comprising a plurality of straps with one end attached to a connector ring and a clasp secured to the other end of each of the straps so that in use at least one of the straps is secured by means of the clasp to the pillow and at least one of the straps is secured by means of the clasp to the elevated surface. The straps may have varying lengths and adjustment means.

20 Claims, 4 Drawing Sheets

PILLOW SECURING DEVICE

The present invention is related to a securing device, and more particularly to a securing device for holding a pillow in place on an elevated surface, such as a hospital bed.

BACKGROUND OF INVENTION

Pillows are used to add comfort to various kinds of elevated surfaces including lounge chairs, recliners, and most notably adjustable beds, particularly of the sort used in hospitals. However, problems have arisen in the utilization of pillows on such elevated surfaces, primarily with preventing the pillow from sliding down or falling off the surface when it is in the elevated position. This is a particular problem in environments where it is desirable to maintain the pillow and bed linens in a sterile environment and where the patients have insufficient strength or flexibility to try to keep the pillow in place.

Attempts made in the past in an effort to solve this problem have been ineffective, have required specialized equipment, or have been difficult to use, particularly by hospital patients with arthritis.

The present invention overcomes the above obstacles by providing a pillow securing device usable with any pillow that is easily used, even by patients with arthritis, in securing a pillow on an elevated surface, such as a hospital bed. Furthermore, the pillow securing device of the present invention does not hinder the comfort of the person resting against the pillow.

SUMMARY OF INVENTION

The present invention is directed to a pillow securing device for releasably holding a pillow in position on an elevated surface. The pillow securing device comprises a plurality of straps with one end of each strap attached or secured to a connector ring and a clasp secured to the other end of each of the straps. In use at least one of the straps is secured by means of the clasp to the pillow and at least one of the straps is secured by means of the clasp to the elevated surface. The straps may have varying lengths and adjustment means.

Other objects and features of the present invention will become apparent from the following detailed description considered in connection with the accompanying drawings. It is to be understood, however, that the drawings are designed as an illustration only and not as a definition of the limits of the invention.

DESCRIPTION OF DRAWINGS

In the drawings, wherein similar reference characters denote similar elements throughout the several views.

DETAILED DESCRIPTION OF INVENTION

The pillow securing device of the present invention includes a plurality of straps with one end co-joined at a central point and with releasable securing devices secured to the other end so that in use the securing devices clasp the pillow and the elevated surface so that the pillow is releasably secured to the elevated surface. A plurality of straps may be used, provided that at least one is used to clasp the pillow and at least one is used to clasp the elevated surface. Construction and operation of the pillow securing device can be understood by reference to the figures and description set forth herein.

Figure 1:
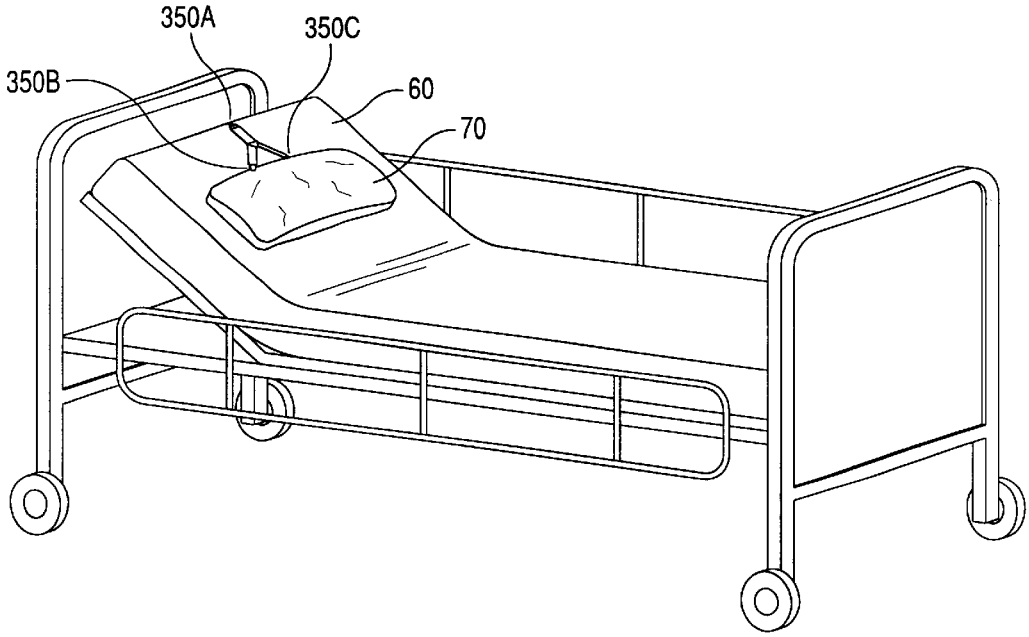
FIG. 1 is a perspective view of the pillow securing device of the present invention in use on a hospital bed.
Figure 2:
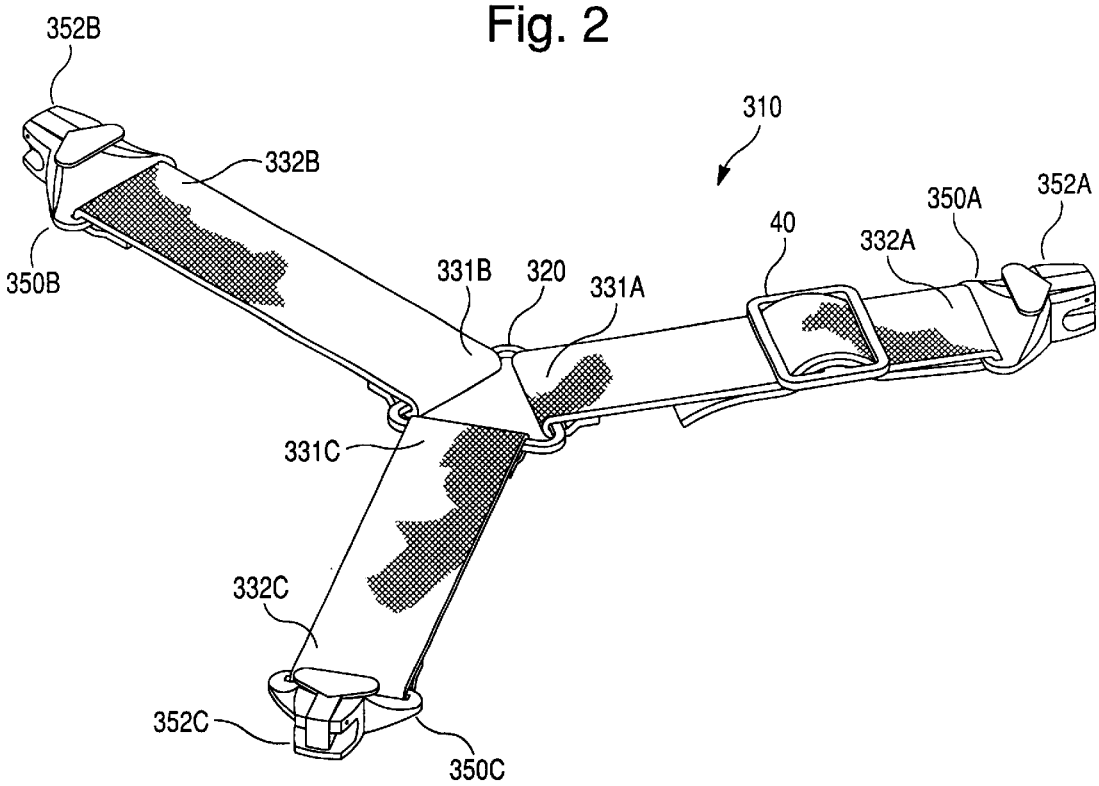
FIG. 2 is a perspective view of the pillow holding device of FIG. 1 with three straps of varying lengths with adjustment means and a triangular connecting ring.

As shown in FIGS. 1 and 2, in one embodiment of the present invention, the pillow securing device 310 of the present invention comprises a plurality of straps 330A, 330B, and 330C each having a respective first end 331A, 331B, and 331C and a respective second end 332A, 3326, and 332C. The first end 331A, 331B, and 331C of straps 330A, 330B, and 330C are attached or secured to a central connecting ring 320. Clasps 352A, 352B, and 352C are attached or secured to the respective second end 332A, 332B, and 332C of straps 330A, 330B, and 330C. The straps 330A, 330B, and 330C may be secured or attached to the connecting ring 320 and to the clasps 350A, 350B, and 350C by any means known in the art including, but not limited to, sewing, gluing, bonding, welding, fusing, and the like, and combinations thereof.

As shown in FIG. 1, one of the clasps, clasp 350A is secured to the elevated bed 60 and the other two clasps, clasps 350B and 350C, are secured to pillow 70 so as to prevent sliding or dislodging of the pillow 70 from the surface of the elevated bed 60.

Figure 3:
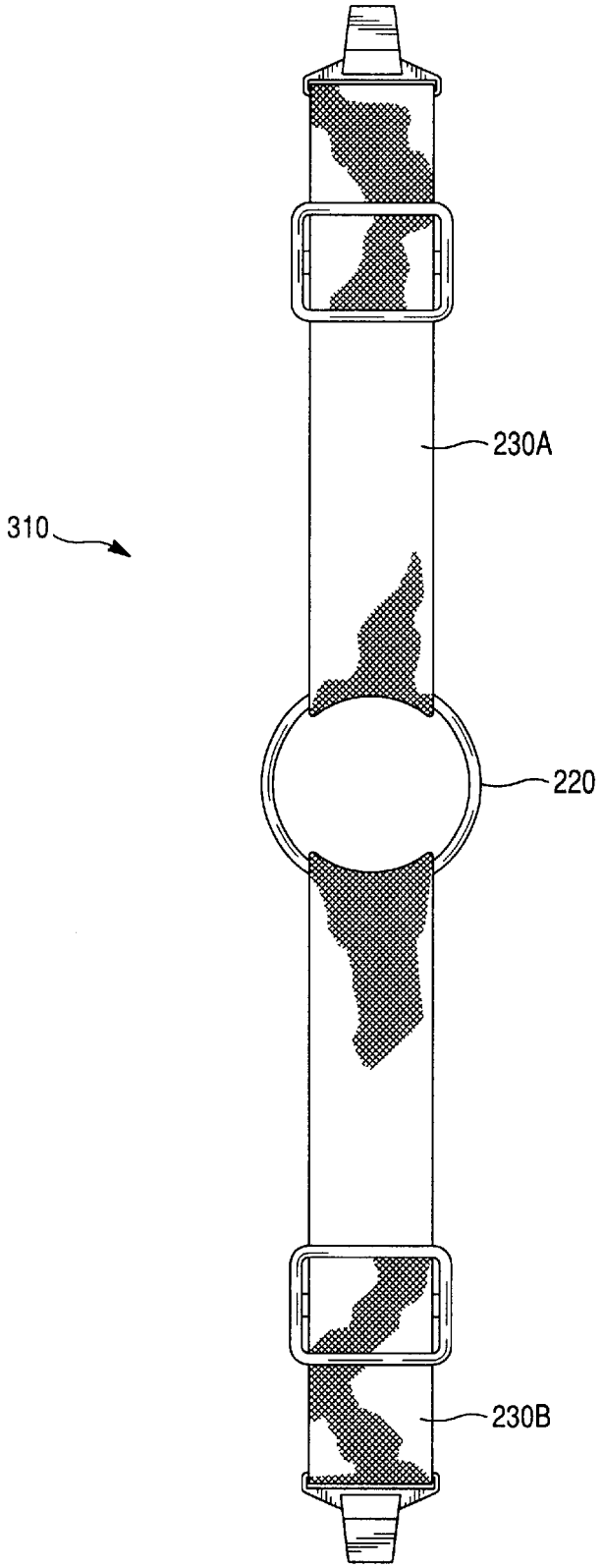
FIG. 3 is a perspective view of the pillow securing device with two straps of the same length and a circular connecting ring.
Figure 4:
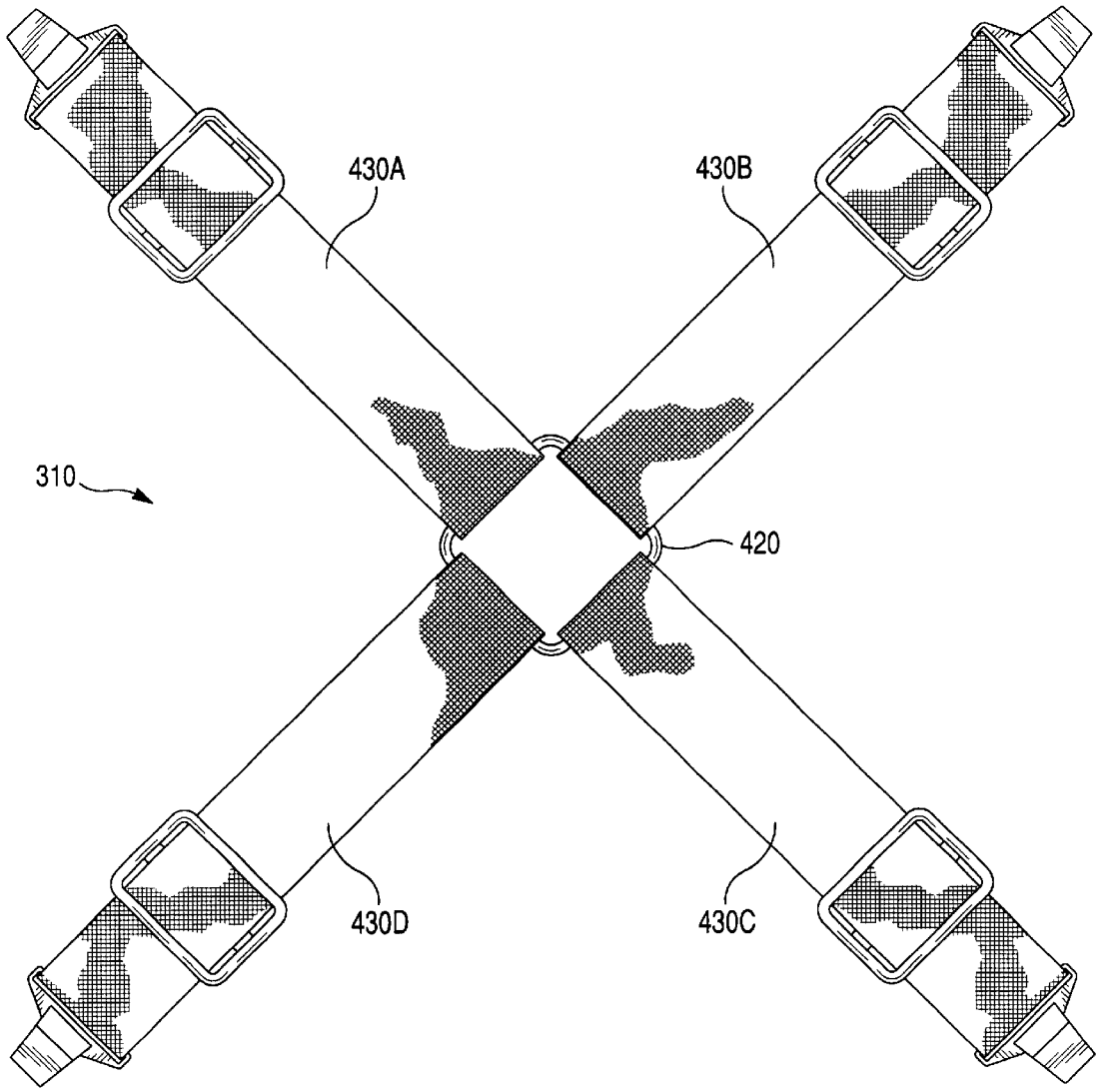
FIG. 4 is a perspective view of the pillow holding device with four straps of the same length each with adjustment means and a square connecting ring.

In other embodiments of the present invention, the number of straps can be varied. For example, FIG. 3 shows the use of two straps 230A and 230B while FIG. 4 shows the use of four straps 430A, 430B, 430C, and 430D. Other numbers of straps may be used and can readily be determined by one of ordinary skill in the art by reference to the figures and teachings of the description set forth herein.

The straps may be of any length and may contain adjustment means so as to provide a more customized fit or to be adaptable to a wider range of environments including pillows and elevated surfaces of varying sizes and types. The straps may be made of any suitable material such as polypropylene webbing, canvas and the like. In a preferred embodiment of the present invention, the straps are capable of withstanding heat, chemical and/or electrical sterilization so that they are suitable for use in a hospital or nursing home environment.

In one embodiment of the invention, adjustment means 40 are used on the straps to adjust the length thereof. Any suitable adjustment means known to one of ordinary skill in the art is suitable for use in the present invention. Preferably the adjustment means are made of a sterilizable material such as metals and plastics such as polypropylene, acetal, or nylon.

The connecting ring 220, 320, or 420 can be of any size or shape. In a preferred embodiment, the connecting ring contains flat sides corresponding in number to the number of straps. For example, in FIGS. 1 and 2, there are three straps 330A, 330B, and 330C and the connecting ring 320 has a triangular shape so that each of the straps can be readily secured in a relatively flat position to the connecting ring, while in the embodiment shown in FIG. 4 there are four straps 430A, 430B, 430C, and 430D that are attached to a connecting ring 420 with a generally square shape. This enables a flatter profile and prevents the straps from slipping around the ring. In another embodiment of the present invention, the connecting ring may be circular or oval in shape. In FIG. 3, the connecting ring 220 has a generally circular shape.

The connecting ring 220, 320 or 420 should be sufficiently rigid and durable to withstand high amounts of tension and be capable of withstanding heat, chemical and/or electrical sterilization. The connecting ring 220, 320, or 420 can be made of any suitable material and is preferably a plastic material such as polypropylene, acetal or nylon.

Figure 5:
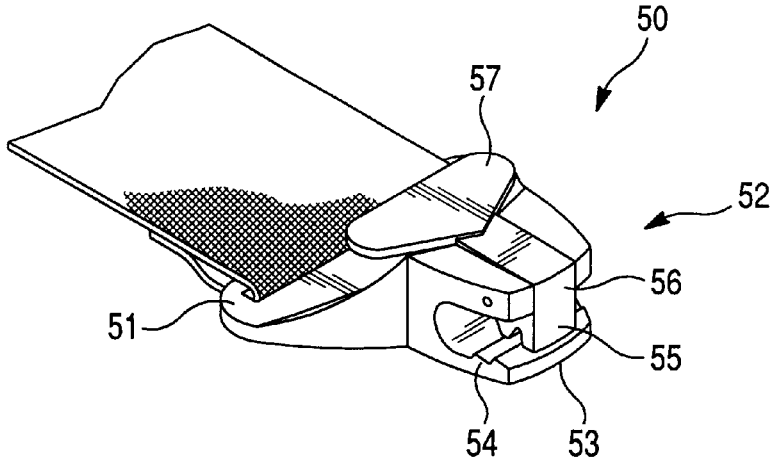
FIG. 5 is a perspective view of one of the securing clasps in a closed position.
Figure 6:
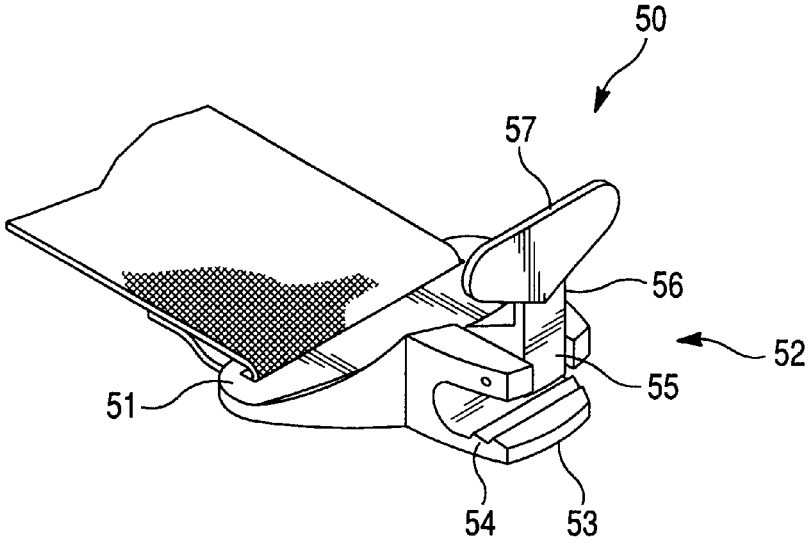
FIG. 6 is a perspective view of the securing clasp of FIG. 5 in an open position.

The clasps may be of any type know to one of ordinary skill in the art and are preferably capable releasably securing the pillow and releasably securing the elevated surface. A clasp suitable for use in the present invention is depicted in FIG. 5 in the closed position and in FIG. 6 in the open position. In referring to these figures, clasp 50 has an attachment portion 51 for securing the clasp 50 to a strap. Any suitable type of attachment portion known to one of ordinary skill in the art may be utilized such as a loop or slot through which the strap is threaded and then secured, a clamping device, and the like. A clamping portion 52 has a base member 53, preferably with gripping means such as teeth 54 with a releasably clamping member 55 with a pivoting portion 56 and a handle portion 57. In a preferred embodiment of the invention, the handle portion is of a sufficient size and shape that it is readily grasped and rotated even by users with arthritis in their hands.

The clasp can be made out of any suitable material, but is preferably polypropylene, acetal or nylon. The clasp must be sufficiently flexible to be bent into the locking shape, but must also be sufficiently rigid and durable to withstand high amounts of tension. Preferably, the clasp is sufficiently rigid so that its shape is not deformed after the ends are locked together, even under high amounts of tension.

Although the present invention has been described in specific and detailed terms with respect to the preferred embodiments as set forth above, various other embodiments of this invention including alterations in size, shape, etc., substitutions of conventional elements and other applications will be readily apparent to those with ordinary skill in the art without departing from the broader spirit and scope of the invention as set forth in the appended claims. Therefore, the specification is to be regarded in an illustrative rather than restrictive sense.

What is claimed is:

1. A pillow securing device for holding a pillow in place on an elevated surface, said pillow securing device comprising:

a connector;

a plurality of straps, wherein each of said straps has a first end and a second end and said first end of each of said straps is attached to said connector; and a plurality of clasps, wherein said clasps are attached to each of said second ends of said straps, wherein at least one clasp is secured to said elevated surface and at least one different clasp is secured to said pillow so as to hold said pillow in place on said elevated surface, and wherein said clasps have a sufficient size and shape, so as to be readily grasped and rotated.

2. The pillow securing device of claim 1, further comprising an adjustment device mounted on one of said straps for adjusting the length of said strap.

3. The pillow securing device of claim 2, wherein said adjustment device is a slide adjustment.

4. The pillow securing device of claim 2, wherein said adjustment device is a plastic.

5. The pillow securing device of claim 1, wherein said connector is a ring.

6. The pillow securing device of claim 5, wherein said ring is triangular in shape.

7. The pillow securing device of claim 5, wherein said ring is made of plastic.

8. The pillow securing device of claim 1, wherein said device is sterilizable.

9. The pillow securing device of claim 1, wherein said straps comprise a polypropylene webbing material.

10. The device of claim 1, wherein said first end of each of said straps is looped around said ring and sewn to a portion of said strap adjacent said ring.

11. The pillow securing device of claim 1, comprising at least three straps wherein at least one clasp is secured to said pillow and at least two different clasps are secured to said elevated surface.

12. The pillow securing device of claim 1, comprising at least three straps wherein at least one clasp is secured to said elevated surface and at least two different clasps are secured to said pillow.

13. A device for releasably holding a pillow in position on an elevated surface, said device comprising:

a ring;

three straps, each of said straps having a first end and a second end, wherein each of said first ends of said straps is attached to said ring; and three clasps, each having a loop end and a clip end, wherein said loop end of each clasp is attached to said second end of one of said straps, wherein at least one of said clip ends is adapted to be releasably attached to said pillow and at least one of said clip ends is adapted to be releasably attached to said elevated surface.

14. The device of claim 13, wherein the first and second straps have a first length and the third strap has a second length.

15. The device of claim 14, wherein said second length is longer than said first length.

16. The device of claim 15, wherein said third strap having said second length further comprises an adjustment device to adjust the length of said strap.

17. The device of claim 15, wherein the clasp on said third strap is releasably secured to said elevated surface and the clasps on said first and second straps are releasably secured to said pillow.

18. The device of claim 15, wherein the clasp on said third strap is releasably secured to said pillow and the clasps on said first and second straps are releasably secured to said elevated surface.

19. The device of claim 13 wherein said ring is triangular in shape.

20. The device of claim 13, wherein said device is sterilizable.

* * * * *